US006431844B1

(12) United States Patent
Dexter et al.

(10) Patent No.: US 6,431,844 B1
(45) Date of Patent: Aug. 13, 2002

(54) HIGH PRESSURE PUMP HAVING INTEGRAL START VALVE

(75) Inventors: Shane Dexter, Humboldt; Allen Palmer, Lexington; Mark Wood, Jackson, all of TN (US)

(73) Assignee: DeVilbiss Air Power Company, Jackson, TN (US)

( * ) Notice: Subject to any disclaimer, the term of this patent is extended or adjusted under 35 U.S.C. 154(b) by 0 days.

(21) Appl. No.: 09/639,435

(22) Filed: Aug. 14, 2000

(51) Int. Cl.[7] ..... F07B 49/00

(52) U.S. Cl. ..... 417/299; 417/307; 417/30

(58) Field of Search ..... 417/299, 36, 300, 417/307

(56) References Cited

U.S. PATENT DOCUMENTS

| | | | | |
|---|---|---|---|---|
| 5,035,580 A | * | 7/1991 | Simonette | 417/34 |
| 5,421,520 A | * | 6/1995 | Simonette et al. | 239/525 |
| 5,718,255 A | * | 2/1998 | Gilpatrick et al. | 137/10 |
| 5,902,094 A | * | 5/1999 | Hoenisch et al. | 417/26 |

* cited by examiner

*Primary Examiner*—Teresa Walberg
*Assistant Examiner*—Thor Campbell
(74) *Attorney, Agent, or Firm*—Suiter & Associates PC

(57) ABSTRACT

A high pressure pump suitable for use in devices such as pressure washers or the like is disclosed wherein the pump's head assembly includes an integral start valve for allowing the fluid through the head assembly so the engine may be more easily started. When the pump reaches a predetermined rate of flow of the fluid, the start valve assembly closes to circulate the fluid through said pump assembly.

18 Claims, 5 Drawing Sheets

HIGH PRESSURE PUMP HAVING INTEGRAL START VALVE

CROSS REFERENCE TO RELATED APPLICATIONS

The present application is related to co-pending U.S. patent application Ser. No. 09/639,573, filed Aug. 14, 2000. Said U.S. patent application Ser. No. 09/639,573 is herein incorporated by reference in its entirety.

The present application is further related to co-pending U.S. patent application Ser. No. 09/639,572, filed Aug. 14, 2000. Said U.S. patent application Ser. No. 09/639,572 is herein incorporated by reference in its entirety.

FIELD OF THE INVENTION

The present invention generally relates to the field of devices such as pressure washers and the like that are capable of delivering a fluid from a supply source and discharging it at a greater pressure, and more particularly to a high pressure pump suitable for use in such devices having an integral start valve.

BACKGROUND OF THE INVENTION

High pressure washing devices, commonly referred to as pressure washers, deliver a fluid, typically water, under high pressure to a surface to be cleaned, stripped or prepared for other treatment. Pressure washers are produced in a variety of designs and can be used to perform numerous functions in industrial, commercial and home applications. Pressure washers typically include an internal combustion engine that drives a pump to which a high pressure spray wand is coupled via a length of hose. Pressure washers may be stationary or portable. Stationary pressure washers are generally used in industrial or commercial applications such as car washes or the like. Portable pressure washers typically include a power/pump unit that can be carried or wheeled from place to place. A source of water, for example, a garden hose, is connected to the pump inlet, and the high pressure hose and spray wand connected to the pump outlet.

Wherein the internal combustion engine utilized to provide power to the pump includes a pull starter that is manually pulled by a user to start the engine, it has been found that the engine may be difficult to start since because the pump must pump water during the start stroke of the engine, thus, making the pull starter difficult to pull. Consequently, it would be desirable to provide a high pressure pump suitable for use in devices such as pressure washers or the like, wherein the pump's head assembly includes an integral start valve for allowing the fluid through the head assembly so the engine may be more easily started.

SUMMARY OF THE INVENTION

Accordingly, the present invention is directed to a high pressure pump suitable for use in devices such as pressure washers, or the like, wherein the pump's head assembly includes an integral start valve for allowing the fluid being pumped to circulate through the head assembly while the engine powering the pump is started. In an exemplary embodiment, the pump includes a pump assembly for pumping the fluid so that its pressure and/or flow rate are increased and a head assembly for porting the fluid to and from the pump assembly. The head assembly includes an inlet portion suitable for receiving a supply of the fluid and an outlet portion suitable for outputting the liquid received from the pump assembly. A start valve assembly disposed in the head assembly circulates fluid within the head assembly from the inlet portion to the outlet portion bypassing the pump assembly as the engine powering the pump is started. When the pump reaches a predetermined rate of flow of the fluid, the start valve assembly closes to circulate the fluid through said pump assembly.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Figure 1:
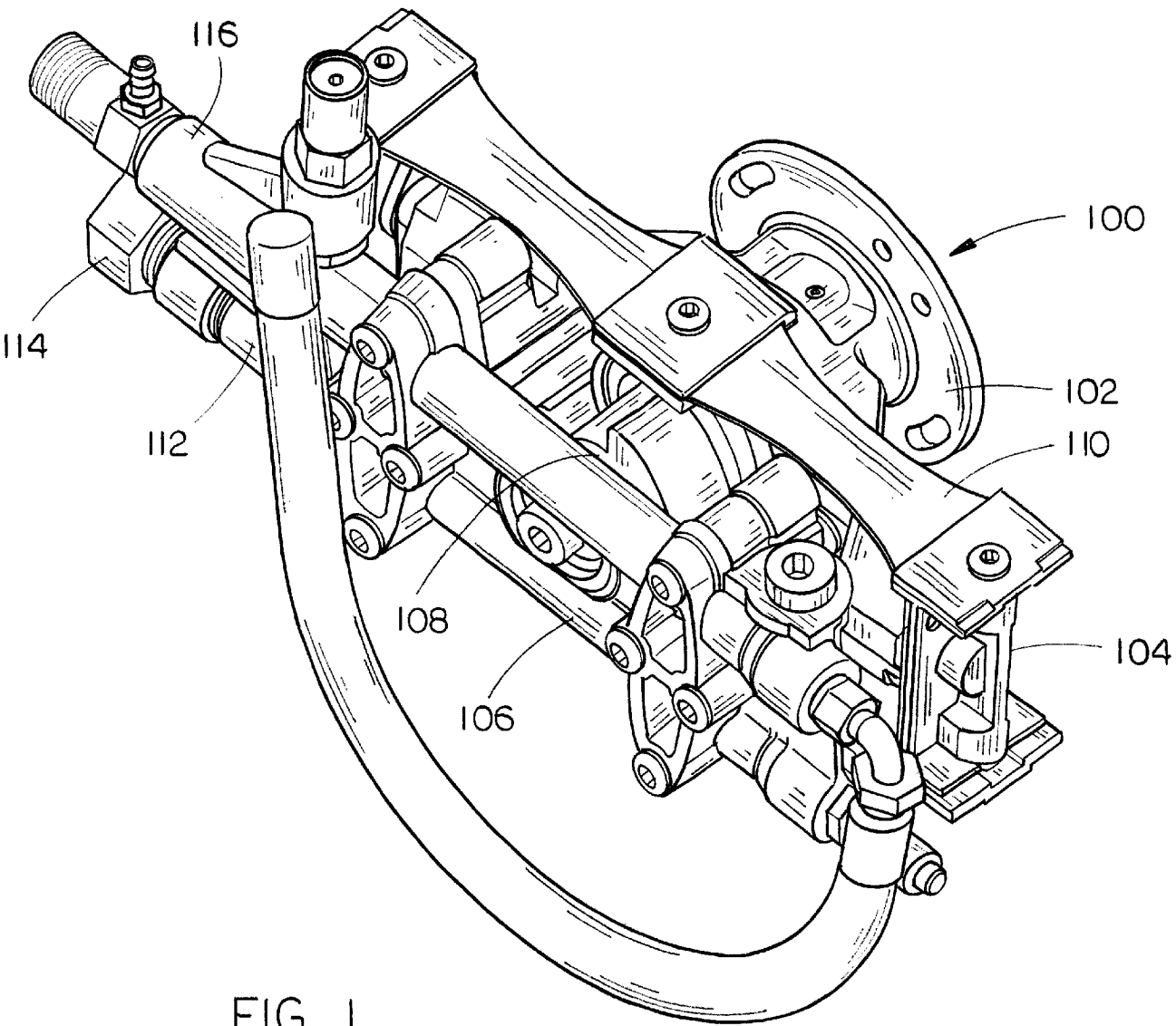
FIG. 1 is an isometric view of a high pressure pump in accordance with an exemplary embodiment of the present invention.

Reference will now be made in detail to the presently preferred embodiments of the invention, examples of which are illustrated in the accompanying drawings.

Referring generally to FIGS. 1 through 4B, an oilless high pressure pump in having a head assembly including an integral start valve in accordance with an exemplary embodiment of the present invention is described. The pump 100 is comprised of a pump assembly 102 supporting one or more piston assemblies 104 suitable for pumping a liquid such as water, or the like and a manifold or head assembly 106, coupled to the pump assembly 102, for porting the liquid to and from the piston assemblies 104. An eccentric assembly 108 converts rotary motion of the rotating shaft of an engine, for example, an engine mounted to the frame assembly of the pressure washer to rectilinear motion for reciprocating the piston assemblies 104. Flexible straps 110 couple the eccentric assembly 108 to the piston assemblies 104 to communicate the rectilinear motion of the eccentric assembly 108 to the piston assemblies 104 to pump the liquid. In exemplary embodiments, the eccentric assembly 108 employs sealed, deep grooved permanently lubricated bearing assemblies.

Figure 2:
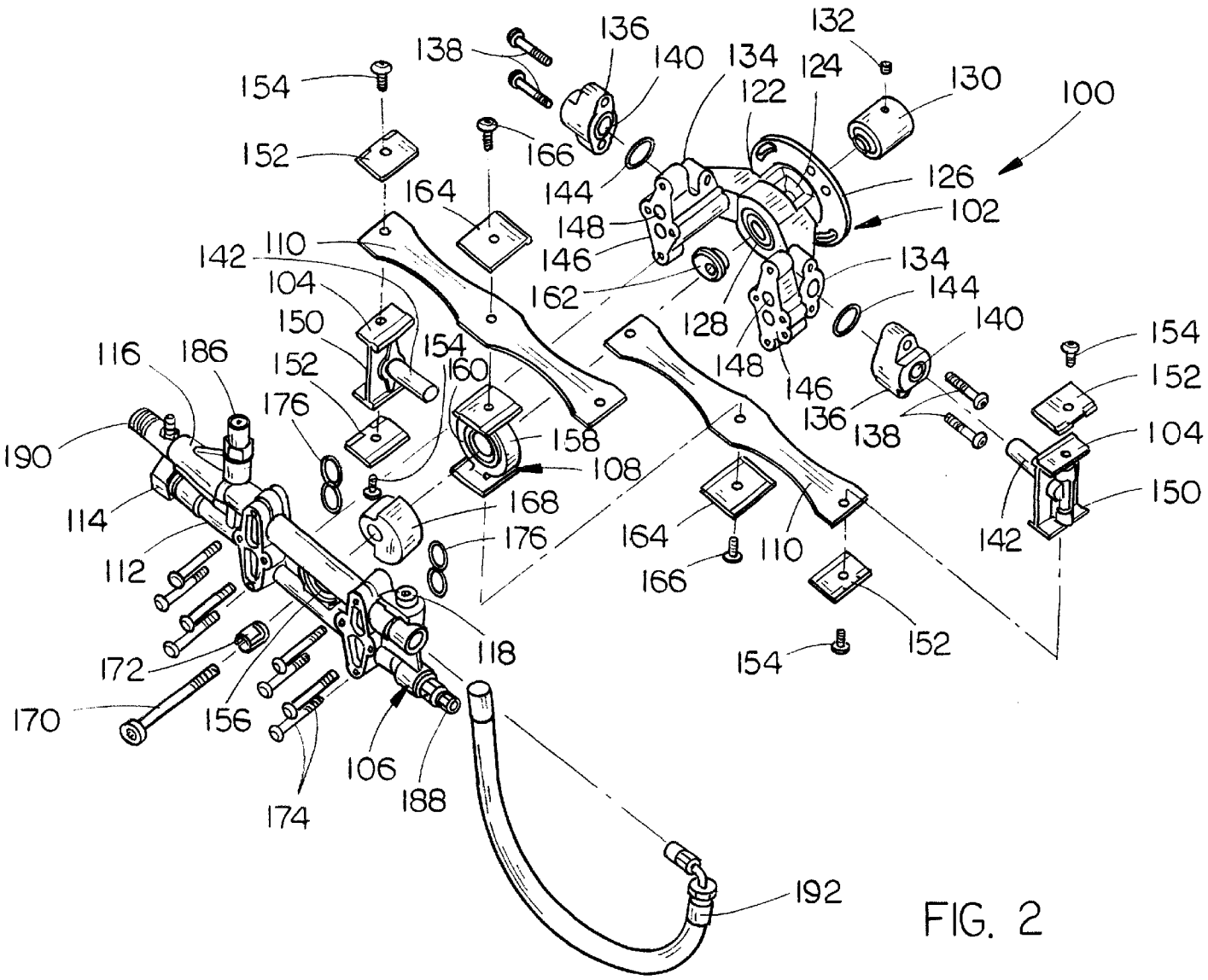
FIG. 2 is an exploded isometric view of the pump shown in FIG. 1 further illustrating the component parts of the pump.

Head assembly 106 ports the fluid through the pump 100 where the pressure and/or flow rate of the fluid is increased from a first pressure and/or flow rate to a second pressure and/or flow rate. As shown in FIG. 2, the head assembly 106 includes an inlet or low pressure portion 112 having a connector 114 such as a conventional garden hose connector, or the like for coupling the pump 100 to a source of fluid, for example, household tap water, at a first pressure and/or flow rate. The head assembly 106 also includes an outlet or high pressure portion 116 for supplying the liquid at a second pressure and/or flow rate.

In accordance with an exemplary embodiment of the present invention, head assembly 106 includes an integral start valve 118 for allowing the fluid being pumped to circulate through the head assembly 106 from the inlet portion to the outlet portion bypassing the pump assembly 102 as the engine powering the pump 100 is started. When the pump 100 reaches a predetermined rate of flow of the fluid, the start valve 118 closes to circulate the fluid through said pump assembly 102 so that it may be pumped. In this manner, the pump 100 of the present invention allows the engine from which it receives power to be more easily started because the engine does not have to pump the fluid during as it starts. For example, wherein such an engine is comprised of an internal combustion engine having a pull starter, the user pulling on the pull starter cord will experience less resistance in the pull cord.

Referring now to FIG. 2, an exemplary pump 100 employing the present invention is described. Pump assembly 102 of pump 100 includes a pump body 122 having an shaft mounting portion 124 including a flange 126 suitable for coupling the pump 100 to an engine such as the internal combustion engine or electric motor of a pressure washer. Preferably, bearing assembly 116 is mounted in the shaft mounting portion 124 for supporting shaft 130 which is coupled to the drive shaft of an engine (not shown) via key 132. Pump body 122 may further include axi-linearly opposed cylinder head bosses 134 to which journal bodies 136 are coupled via fasteners 138 to form cylinders 140 in which pistons 142 of piston assemblies 104 may reciprocate. A seal such as an O-ring or the like 144 may be disposed between each cylinder head boss 134 and journal body 136 for preventing leakage of the liquid from the cylinders 140 during operation of the pump 100. Head coupling bosses 146 formed in pump body 122 provide a surface for coupling the head assembly 106 to the pump assembly 102 and include ports 148 for porting the liquid to and from the cylinders 140 and piston assemblies 104.

Each piston assembly 104 includes a strap coupling member 150 mounted to the outer end of piston 142 for coupling the piston 142 to straps 110. In the exemplary embodiment shown, straps 110 are clamped to the strap coupling members 150 by end clamp block 152 and fastener 154. This clamping arrangement allows loads to be more evenly distributed through the ends of straps 110.

In an exemplary embodiment, pistons 142 are formed of a ceramic material. However, it will be appreciated that pistons 142 may alternately be formed of other materials, for example metals such as aluminum, steel, brass, or the like without departing from the scope and spirit of the present invention. Cylinders 140 formed in journal bodies 136 may include a seal providing a surface against which the piston 142 may reciprocate and for preventing liquid within the cylinder 140 from seeping between the piston 142 and cylinder wall. Preferably, the seal is formed of a suitable seal material such as tetrafluoroethylene polymers or Teflon (Teflon is a registered trademark of E.I. du Pont de Nemours and Company), a butadiene derived synthetic rubber such as Buna N, or the like.

In the exemplary embodiment of the invention shown in FIG. 2, eccentric assembly 108 includes shaft 130, bearing assemblies 116 & 128, and an eccentric 158. The eccentric 158 is comprised of a ring bearing assembly 160 and a bearing coupling member 162 for coupling the ring bearing assembly 158 to bearing assembly 116. Ring bearing assembly 158 is further coupled to straps 110 via clamp blocks 164 and fasteners 166 which clamp the center of straps 110 to the ring bearing assembly 160. This clamping arrangement allows loads within the center of strap 110 to be distributed more evenly. A counterweight 168 may be provided for balancing movement of the eccentric assembly 108 and piston assemblies 104 to reduce or eliminate vibration of the pump 100 during operation.

Figure 3:
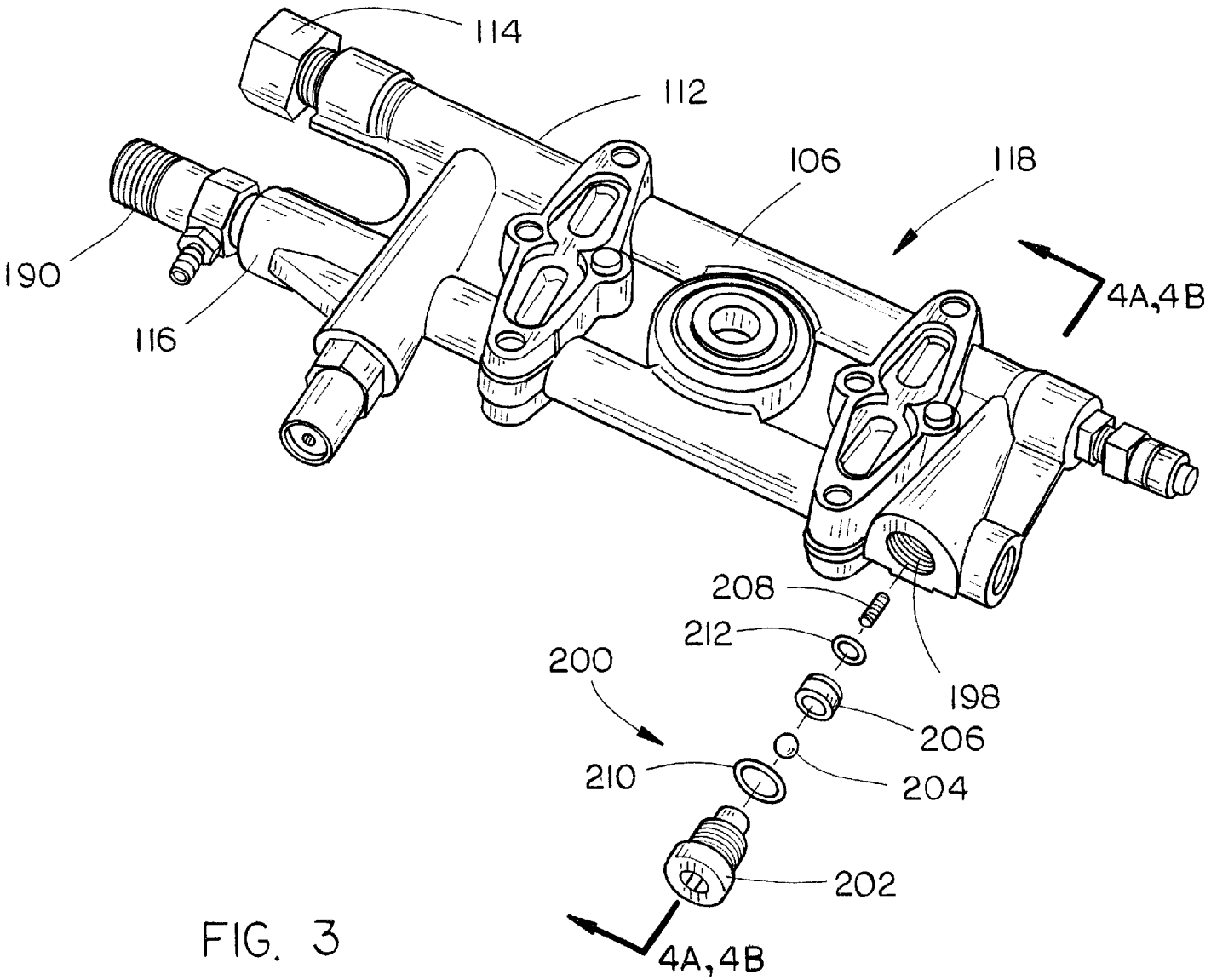
FIG. 3 is a partially exploded isometric view of the head assembly of the pump shown in FIG. 1, further illustrating the integral start valve.

Eccentric assembly 108 includes shaft 130, bearing assemblies 128 & 156, and an eccentric 158. The eccentric 158 is comprised of a ring bearing assembly 160 and a bearing coupling member 162 for coupling the ring bearing assembly 158 to bearing assembly 128. Ring bearing assembly 158 is further coupled to straps 110 via clamp blocks 164 and fasteners 166 which clamp the center of straps 110 to the ring bearing assembly 160. This clamping arrangement allows loads within the center of strap 110 to be distributed more evenly. A counterweight 168 may be provided for balancing movement of the eccentric assembly 108 and piston assemblies 104 to reduce or eliminate vibration of the pump 100 during operation. Eccentric assembly 108 is secured together by fastener 170. Preferably, fastener 170 extends through bearing assembly 156, counterweight 168, ring bearing assembly 160, bearing coupling member 162, and bearing assembly 128 and is threaded into the center of shaft 130 to clamp these components together. As shown in FIG. 3, fastener 170 is off-centered in bearing coupling member 162 so that the ring bearing assembly 158 is positioned axially off-center with respect to the center of shaft 130 allowing the eccentric 156 to convert the rotary motion of the shaft 130 to rectilinear motion that is communicated to the piston assemblies 104 by straps 110 for reciprocating pistons 142. Collet 172 is engaged within bearing assembly 128 by fastener 170 for capturing and providing the proper pre-loading of bearing assemblies 128 & 156. Fastener 170 and collet 172 is described in co-pending U.S. patent application Ser. No. 09/639,572, filed Aug. 14, 2000, which is incorporated herein by reference in its entirety. Straps 110 and bearing assemblies 116 & 128 are further described in co-pending U.S. patent application Ser. No. 09/639,573, filed Aug. 14, 2000, which is incorporated herein by reference in its entirety.

In the exemplary embodiment shown, head assembly 106 is secured to the head coupling bosses 146 of pump body 122 by fasteners 174. Seals such as a shaped O-ring, gasket, or the like 178 may be disposed between the head assembly 106 and head coupling bosses 146 for preventing leakage of the liquid during operation of the pump 100. In exemplary embodiments, the head assembly 106 may include a pressure unloader valve 186 for regulating pressure supplied by the pump and a thermal relief valve 188 to relieve excess pressure caused by thermal stresses. An injector assembly 190 may be provided for injecting a substance, for example, soap, into the fluid supplied by the outlet portion 184. A dampener hose 192 may be coupled to the outlet portion 184. The dampener hose 192 expands and lengthens to absorb pressure pulsations in the fluid induced by pumping. Alternately, other devices such as a spring piston assembly or the like may be employed instead of the dampener hose 192 to absorb pressure pulsations and substitution of such devices by those of ordinary skill in the art would not depart from the scope and spirit of the present invention.

Figure 4A:
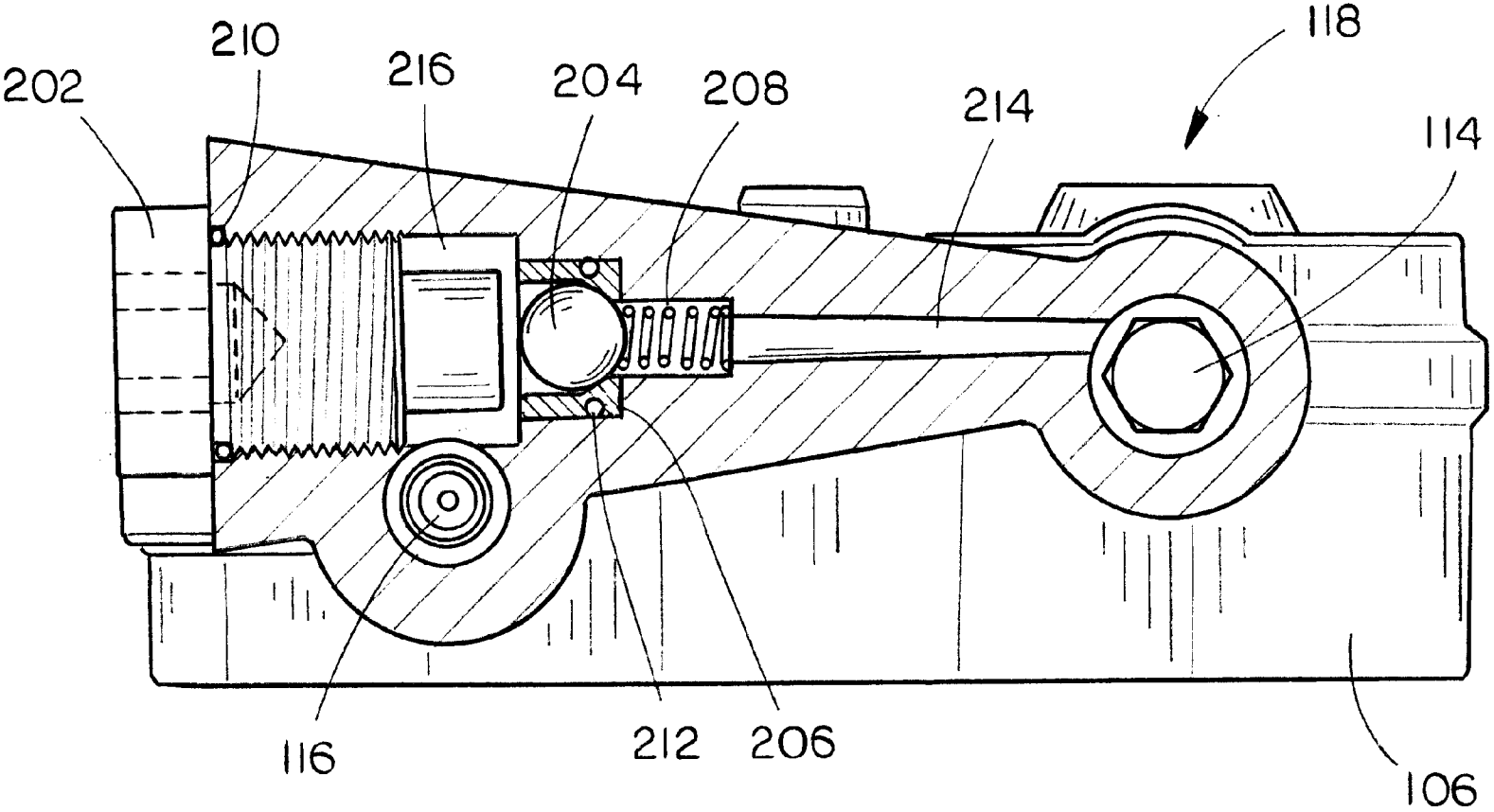
FIGS. 4A and 4B are cross-sectional views of the integral start valve shown in FIG. 3 taken along lines 4A—4A and 4B—4B respectively, further illustrating operation of the start valve.
Figure 4B:
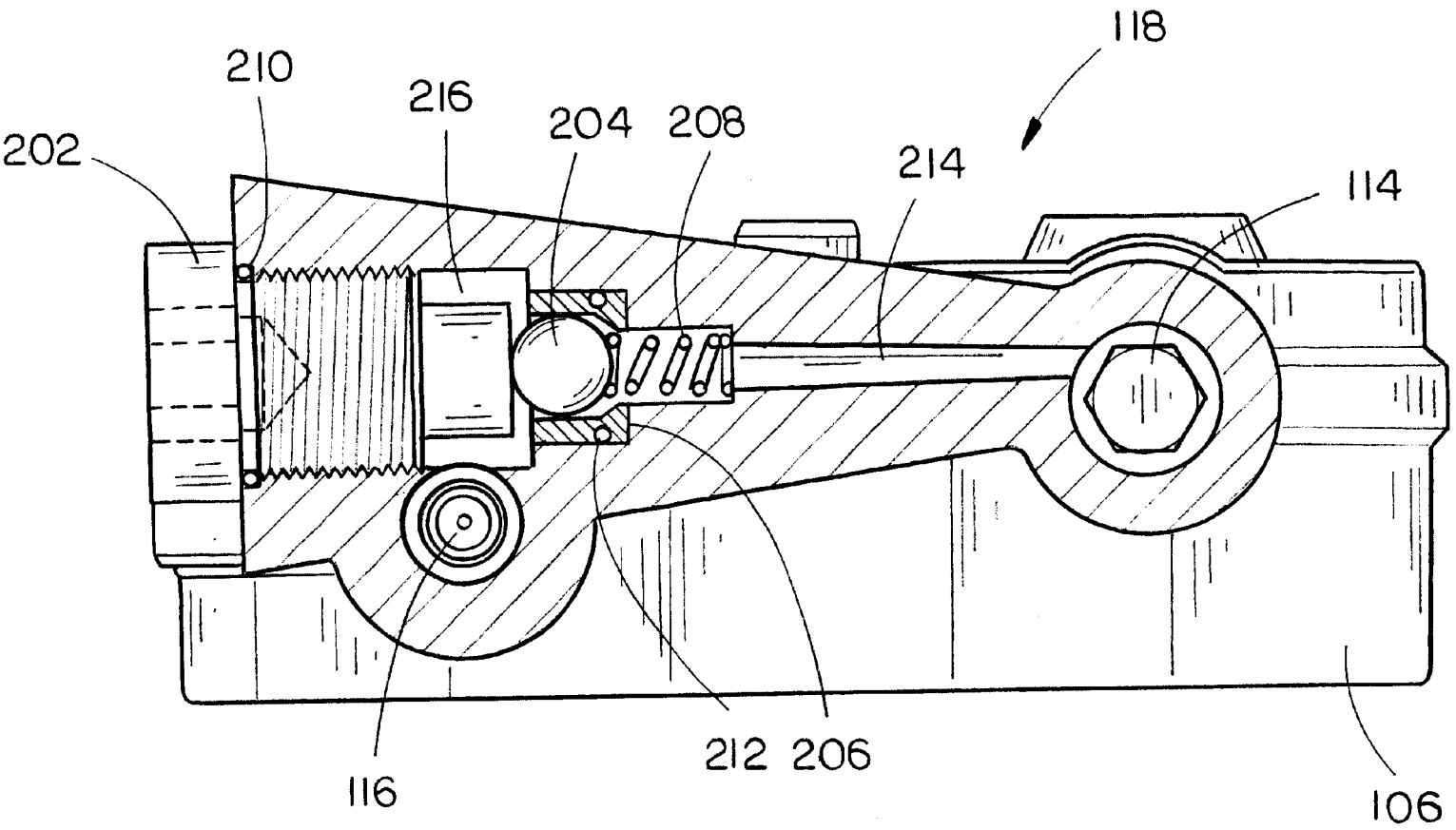

Referring now to FIGS. 3, 4A and 4B, the start valve 118 is described in greater detail. In an exemplary embodiment, start valve 118 is comprised of a valve body 198 formed in the head assembly 106 in which a ball valve assembly 200 is disposed. A plug 202 is provided for enclosing the ball valve assembly in the valve body 200. As shown in FIG. 3, ball valve assembly 200 includes ball 204, ball seat 206, and spring 208. Suitable seals 210 & 212 such as O-rings, washers, or the like may be provided for preventing loss of the fluid being pumped past plug 202, and for preventing seepage of the fluid from the past the ball seat 202 from the outlet portion 116 to the inlet portion when the start valve 118 is closed.

When the engine powering pump 100 is not running, ball valve assembly 200 is biased open as shown in FIG. 4A. Ball 204 of ball valve assembly 200 is held away from ball seat 206 by spring 208. When a source of fluid, for example, tap water supplied by a conventional garden hose, is attached to the inlet portion 112 of head assembly 106 via connector 114 (FIG. 2), fluid is allowed to pass from the inlet portion 112 though port 214 to the outlet portion 116 past ball valve assembly 200. In this manner, fluid is allowed to circulate through the head assembly 106 bypassing the pump assembly 102 (FIG. 2). Consequently, as the engine is started, it does not have to overcome the buildup of pressure within the fluid in the pump's cylinders 140 (FIG. 2).

After the engine is started, pumping of the fluid by the pump assembly 122 increases the pressure, volume, and rate of flow of fluid in the outlet portion 116 of the head assembly 106. As shown in FIG. 4B, once a predetermined rate of flow is achieved, the pressure of fluid in the outlet portion 116 of head assembly 106 overcomes spring 208 and causes ball 204 to be forced against ball seat 206 substantially or completely blocking port 214, closing the start valve 118. In this manner, the fluid is not allowed to bypass the pump assembly 102 by circulating through the head assembly 106 so that the fluid may be pumped.

It is believed that the present invention and many of its attendant advantages will be understood by the forgoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. A pump for pumping a liquid, comprising a pump assembly having a piston assembly for pumping the liquid from a first pressure to a second pressure;

an eccentric assembly suitable for converting rotary motion of a rotating shaft of an engine to rectilinear motion;

a flexible strap for coupling said eccentric assembly and said piston assembly;

a head assembly coupled to said pump assembly, said head assembly including an inlet portion suitable for receiving the liquid at the first pressure and an outlet portion suitable for outputting the liquid at the second pressure; and a valve assembly disposed in said head assembly, said valve being suitable for opening to circulate the liquid within said head assembly from said inlet portion to said outlet portion as said pump is started and closing to circulate the liquid through said pump assembly above a predetermined rate of flow of the liquid, wherein said strap is suitable for communicating the rectilinear motion of said eccentric assembly to said piston assembly for reciprocating said piston to pump said liquid.

2. The pump as claimed in claim 1, wherein said head assembly includes a formed valve body having a port from said inlet portion to said outlet portion.

3. The pump as claimed in claim 2, wherein said valve assembly includes a ball, a ball seat, and a spring, wherein said ball is held away from said ball seat by said spring as said pump is started opening said port and allowing circulation of the liquid between said inlet portion and said outlet portion, and wherein the liquid forces said ball against said ball seat overcoming said spring to at least partially block said port once the predetermined flow of the liquid is achieved.

4. The pump as claimed in claim 3, further comprising a plug for closing said valve body.

5. The pump as claimed in claim 4, wherein said eccentric assembly comprises:

a shaft suitable for being coupled to the drive shaft of an engine;

at least one bearing assembly for supporting said shaft in said pump assembly so that said shaft may rotate; and an eccentric for converting the rotary motion of said shaft to rectilinear motion.

6. The pump as claimed in claim 5, wherein said at least one bearing assembly comprises a sealed bearing.

7. The pump as claimed in claim 5, wherein said eccentric assembly further comprises a counterweight assembly coupled to said shaft for counterbalancing said piston assembly.

8. The pump as claimed in claim 1, wherein said strap is shaped so that loads within the strap are distributed substantially uniformly throughout the strap.

9. A pressure washer, comprising a pump suitable for being coupled to an engine, said pump further comprising a pump assembly having at least one piston assembly, said piston assembly driven by said engine for pumping the liquid from a first pressure to a second pressure;

an eccentric assembly suitable for converting rotary motion of a rotating shaft of the engine to rectilinear motion;

a flexible strap for coupling said eccentric assembly and said piston assembly;

a head assembly coupled to said pump assembly, said head assembly including an inlet portion suitable for receiving the liquid at the first pressure and an outlet portion suitable for outputting the liquid at the second pressure;

a valve assembly disposed in said head assembly, said valve being suitable for opening to circulate the liquid within said head assembly from said inlet portion to said outlet portion as said pump is started and closing to circulate the liquid through said piston assembly once a predetermined rate of flow of the liquid through the pump is achieved, wherein said strap is suitable for communicating the rectilinear motion of said eccentric assembly to said piston assembly for reciprocating said piston to pump said liquid.

10. The pressure washer as claimed in claim 9, wherein said head assembly includes a formed valve body having a port from said inlet portion to said outlet portion.

11. The pressure washer as claimed in claim 10, wherein said valve assembly includes a ball, a ball seat, and a spring, wherein said ball is held away from said ball seat by said spring as said pump is started opening said port and allowing circulation of the liquid between said inlet portion and said outlet portion, and wherein the liquid forces said ball against said ball seat overcoming said spring to at least partially block said port once the predetermined flow of the liquid is achieved.

12. The pressure washer as claimed in claim 11, further comprising a plug for closing said valve body.

13. The pressure washer as claimed in claim 1, wherein said eccentric assembly comprises:

a shaft suitable for being coupled to the drive shaft of an engine;

at least one bearing assembly for supporting said shaft in said pump assembly so that said shaft may rotate; and an eccentric for converting the rotary motion of said shaft to rectilinear motion.

14. The pressure washer as claimed in claim 13, wherein said at least one bearing assembly comprises a sealed bearing.

15. The pressure washer as claimed in claim 13, wherein said eccentric assembly further comprises a counterweight assembly coupled to said shaft for counterbalancing said piston assembly.

16. The pressure washer as claimed in claim 9, wherein said strap is shaped so that loads within the strap are distributed substantially uniformly throughout the strap.

17. A pump for pumping a liquid, comprising a pump assembly for pumping the liquid from a first pressure to a second pressure;

a head assembly coupled to said pump assembly, said head assembly including an inlet portion suitable for receiving the liquid at the first pressure and an outlet portion suitable for outputting the liquid at the second pressure;

an eccentric assembly suitable for converting rotary motion of a rotating shaft to rectilinear motion;

a flexible strap for coupling said eccentric assembly and said piston assembly; and means, disposed in said head assembly, for circulating the liquid within said head assembly from said inlet portion to said outlet portion as said pump is started, wherein said strap is suitable for communicating the rectilinear motion of said eccentric assembly to said piston assembly for reciprocating said piston to pump said liquid.

18. The pump as claimed in claim 17, wherein said circulating means further circulates the liquid the liquid through said pump assembly above a predetermined rate of flow of the liquid.

* * * * *